US012359845B1

(12) United States Patent
Bultema et al.

(10) Patent No.: US 12,359,845 B1
(45) Date of Patent: Jul. 15, 2025

(54) AIR FUNNEL FOR A HEAT PUMP SYSTEM OF A WATER HEATER

(71) Applicant: BRADFORD WHITE CORPORATION, Ambler, PA (US)

(72) Inventors: Joshua Bultema, Grandville, MI (US); Benjamin De Jager, Ada, MI (US); Michael Richards, Byron Center, MI (US)

(73) Assignee: Bradford White Corporation, Ambler, PA (US)

( * ) Notice: Subject to any disclaimer, the term of this patent is extended or adjusted under 35 U.S.C. 154(b) by 0 days.

(21) Appl. No.: 18/895,930

(22) Filed: Sep. 25, 2024

Related U.S. Application Data

(60) Provisional application No. 63/568,486, filed on Mar. 22, 2024.

(51) Int. Cl.
*F24H 9/02* (2006.01)
*F24H 9/14* (2006.01)

(52) U.S. Cl.
CPC ..... *F24H 9/146* (2013.01); *F24H 9/02* (2013.01)

(58) Field of Classification Search
CPC ..... F24H 9/02; F24H 9/146
See application file for complete search history.

(56) References Cited

U.S. PATENT DOCUMENTS

| | | | | |
|---|---|---|---|---|
| 2,516,094 | A * | 7/1950 | Ruff | F25B 30/02 165/47 |
| 8,991,638 | B2 | 3/2015 | Nelson et al. | |
| 10,718,549 | B2 * | 7/2020 | Pugh | F25B 30/02 |
| 11,506,420 | B2 * | 11/2022 | Porwal | F25B 41/42 |
| 11,519,671 | B2 * | 12/2022 | Bhaskar | F28D 1/05391 |

FOREIGN PATENT DOCUMENTS

| | | | | |
|---|---|---|---|---|
| CN | 111801534 | A * | 10/2020 | F24D 17/02 |
| EP | 3705796 | A1 * | 9/2020 | |
| KR | 20130028469 | A * | 3/2013 | |
| WO | WO-2023235249 | A1 * | 12/2023 | F24D 19/08 |
| WO | WO-2024066818 | A1 * | 4/2024 | |

* cited by examiner

*Primary Examiner* — Gregory A Wilson
(74) *Attorney, Agent, or Firm* — Price Heneveld LLP

(57) ABSTRACT

A water heating appliance includes a heat exchanger that draws heat from process air and delivers the heat to a heat exchange media. The heat exchanger has a polygonal cross-section defining a first area. The water heating appliance also includes a blower that delivers the process air through the heat exchanger. The water heating appliance further includes a funnel that directs the process air from the heat exchanger to the blower. The funnel manages an air pressure of the process air to be consistent within the heat exchanger, and the funnel regulates the air pressure of the process air to decrease evenly and consistently between a downstream surface of the heat exchanger and a port that directs the process air into the blower.

20 Claims, 17 Drawing Sheets

AIR FUNNEL FOR A HEAT PUMP SYSTEM OF A WATER HEATER

CROSS-REFERENCE TO RELATED APPLICATION

This application claims priority to and the benefit under 35 U.S.C. § 119 (e) of U.S. Provisional Application No. 63/568,486, filed Mar. 22, 2024, and entitled "AIR FUNNEL FOR A HEAT PUMP SYSTEM OF A WATER HEATER," the entire disclosure of which is hereby incorporated herein by reference.

FIELD OF THE DISCLOSURE

The present disclosure generally relates to a heat pump system for a water heater, and more specifically, to an air funnel for directing a flow of process air through a heat exchanger of a heat pump system.

BACKGROUND OF THE DISCLOSURE

Water heaters are utilized for transferring heat into a reservoir of water for delivery throughout a structure. Certain water heaters utilize a heat pump system that utilizes a thermal exchange media for transferring heat between an evaporating device that absorbs heat from the surrounding area and to a condensing device which rejects heat into the water being heated. Blowers are typically utilized for producing an airflow through portions of the heat pump system.

SUMMARY OF THE DISCLOSURE

According to one aspect of the present disclosure, a water heater includes a heat pump system that has a heat exchanger that absorbs heat from process air for delivery into a heat exchange media. The heat exchanger has an outer perimeter that defines a first dimension. A blower selectively draws the process air through the heat exchanger. A funnel extends between the outer perimeter of the heat exchanger and the blower. The funnel includes a rounded port that has an inner perimeter that defines a second dimension. The second dimension is smaller than the first dimension. The funnel has an inner surface that maintains an air pressure of the process air to be generally consistent within the heat exchanger.

According to another aspect of the present disclosure, an airflow system for a water heater includes a heat exchanger that draws heat from process air. The heat exchanger delivers the heat to a heat exchange media. The heat exchanger has a rectilinear cross-section that defines a first area. A blower delivers the process air through the heat exchanger. A funnel directs the process air from the heat exchanger to the blower. The funnel directs the process air to be consistent within the heat exchanger, and regulates the air pressure of the process air to decrease evenly and consistently between a downstream surface of the heat exchanger and a rounded port that directs the process air into the blower.

According to yet another aspect of the present disclosure, a heat exchange system for a water heater includes an evaporator that draws heat from process air. A heat exchanger delivers the heat to a heat exchange media. The heat exchanger has a generally rectilinear cross-section that defines a first area. A blower delivers the process air through the evaporator. A funnel at least partially surrounds an outer edge of the evaporator and includes a circular port that directs the process air from the evaporator to the blower. The circular port defines an inner perimeter that directs a second area. The second area is smaller than the first area. The funnel manages an air velocity of the process air to be even and consistent within the heat exchanger, and regulates the air velocity of the process air to define a consistent increase as the process air moves between a downstream surface of the evaporator and the circular port.

According to yet another aspect of the present disclosure, a water heating appliance includes a heat exchanger that draws heat from process air and delivers the heat to a heat exchange media. The heat exchanger has a polygonal cross-section defining a first area. The water heating appliance also includes a blower that delivers the process air through the heat exchanger. The water heating appliance further includes a funnel that directs the process air from the heat exchanger to the blower. The funnel manages an air pressure of the process air to be consistent within the heat exchanger, and the funnel regulates the air pressure of the process air to decrease evenly and consistently between a downstream surface of the heat exchanger and a rounded port that directs the process air into the blower.

These and other features, advantages, and objects of the present disclosure will be further understood and appreciated by those skilled in the art by reference to the following specification, claims, and appended drawings.

The components in the figures are not necessarily to scale, emphasis instead being placed upon illustrating the principles described herein.

DETAILED DESCRIPTION

As required, detailed embodiments of the present disclosure are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

Figure 1:
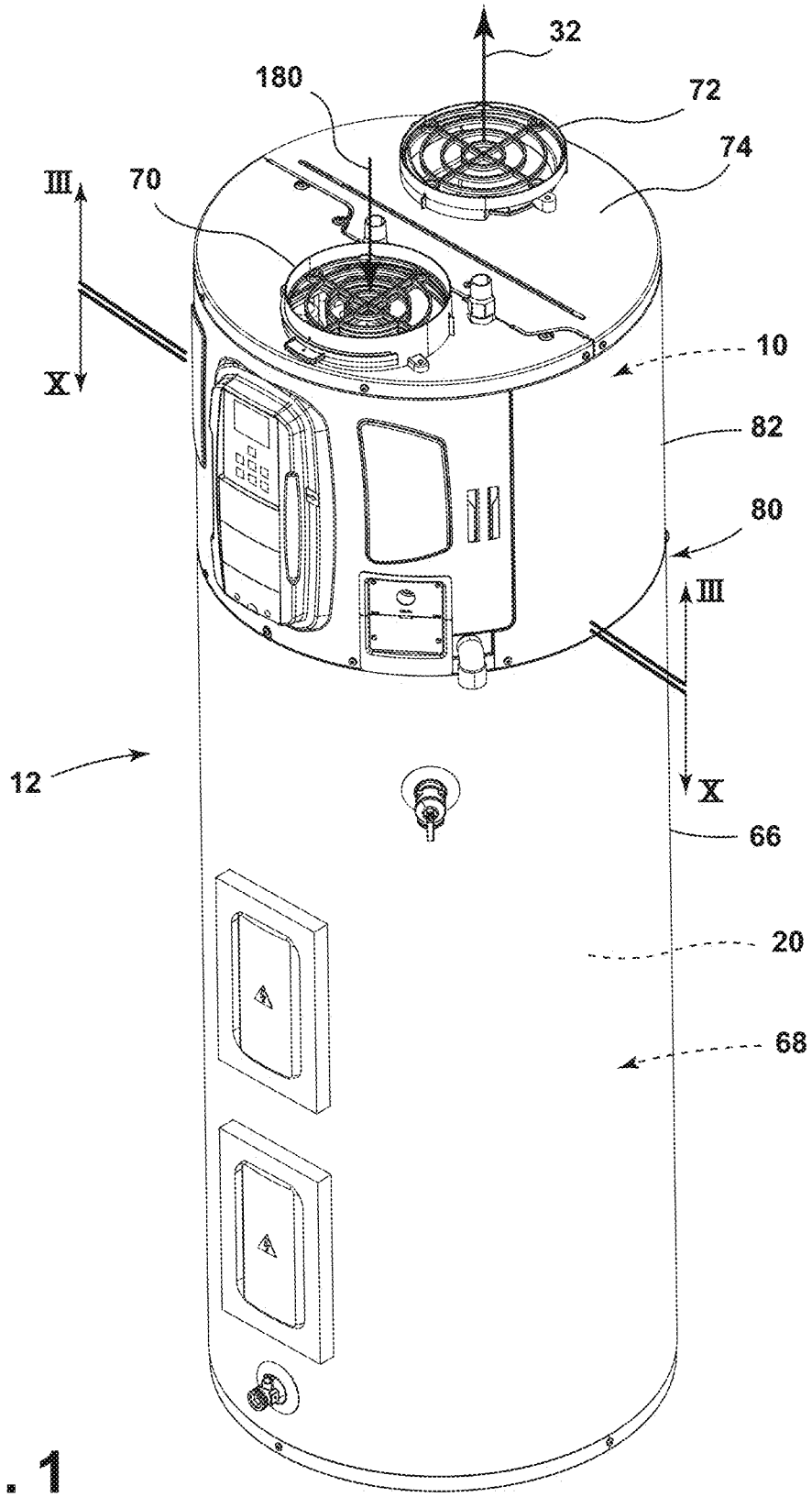
FIG. 1 is a top perspective view of a water heater that incorporates an aspect of an air funnel.
Figure 2:
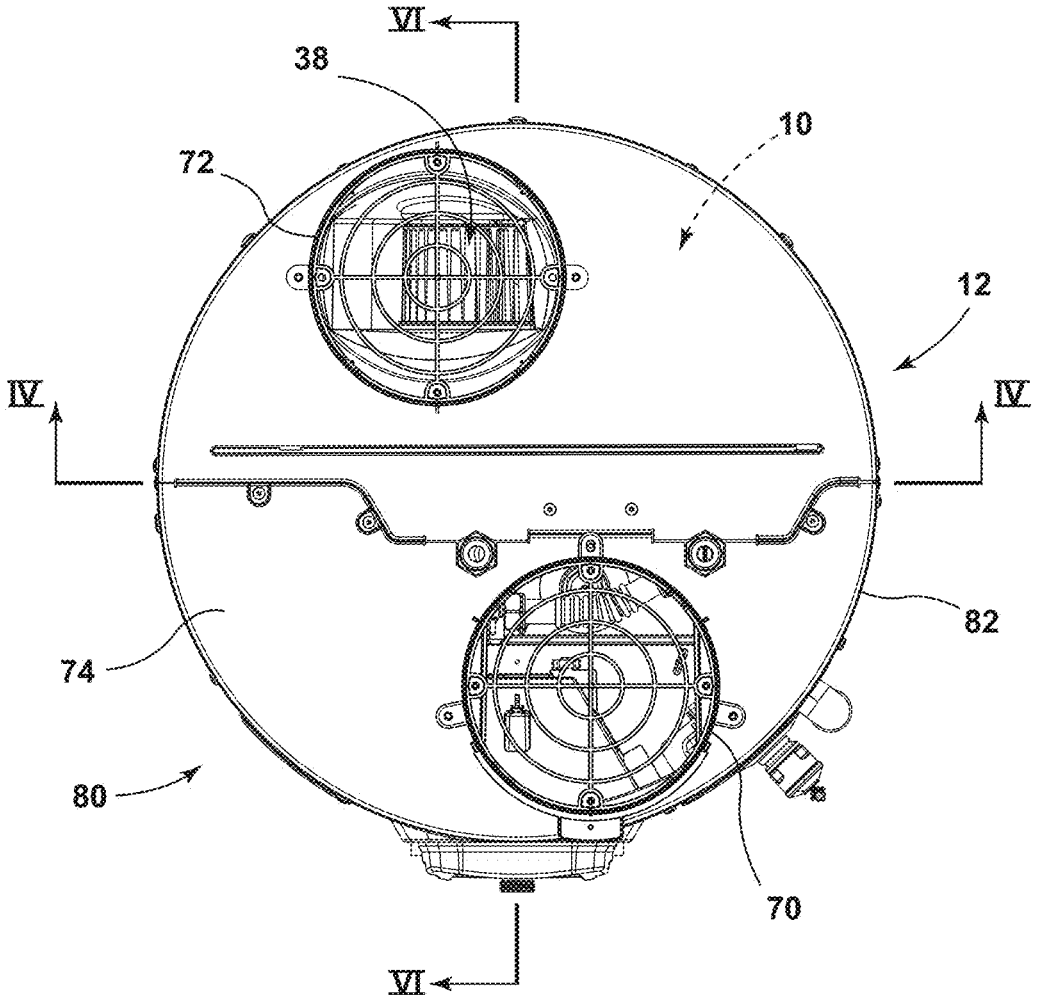
FIG. 2 is a top plan view of the water heater of FIG. 1.
Figure 3:
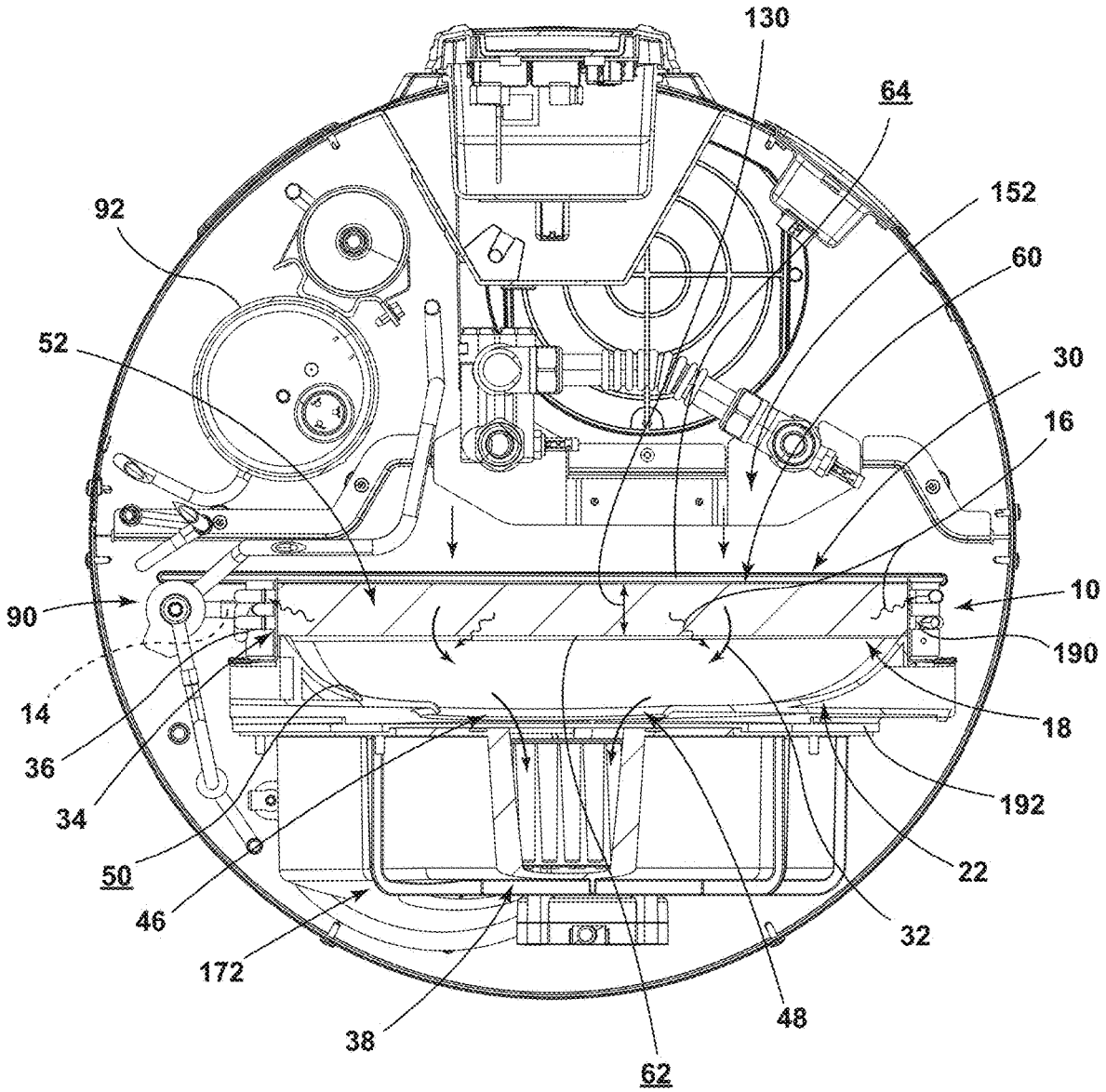
FIG. 3 is a cross-sectional view of the water heater of FIG. 1 taken along the line III-III.
Figure 4:
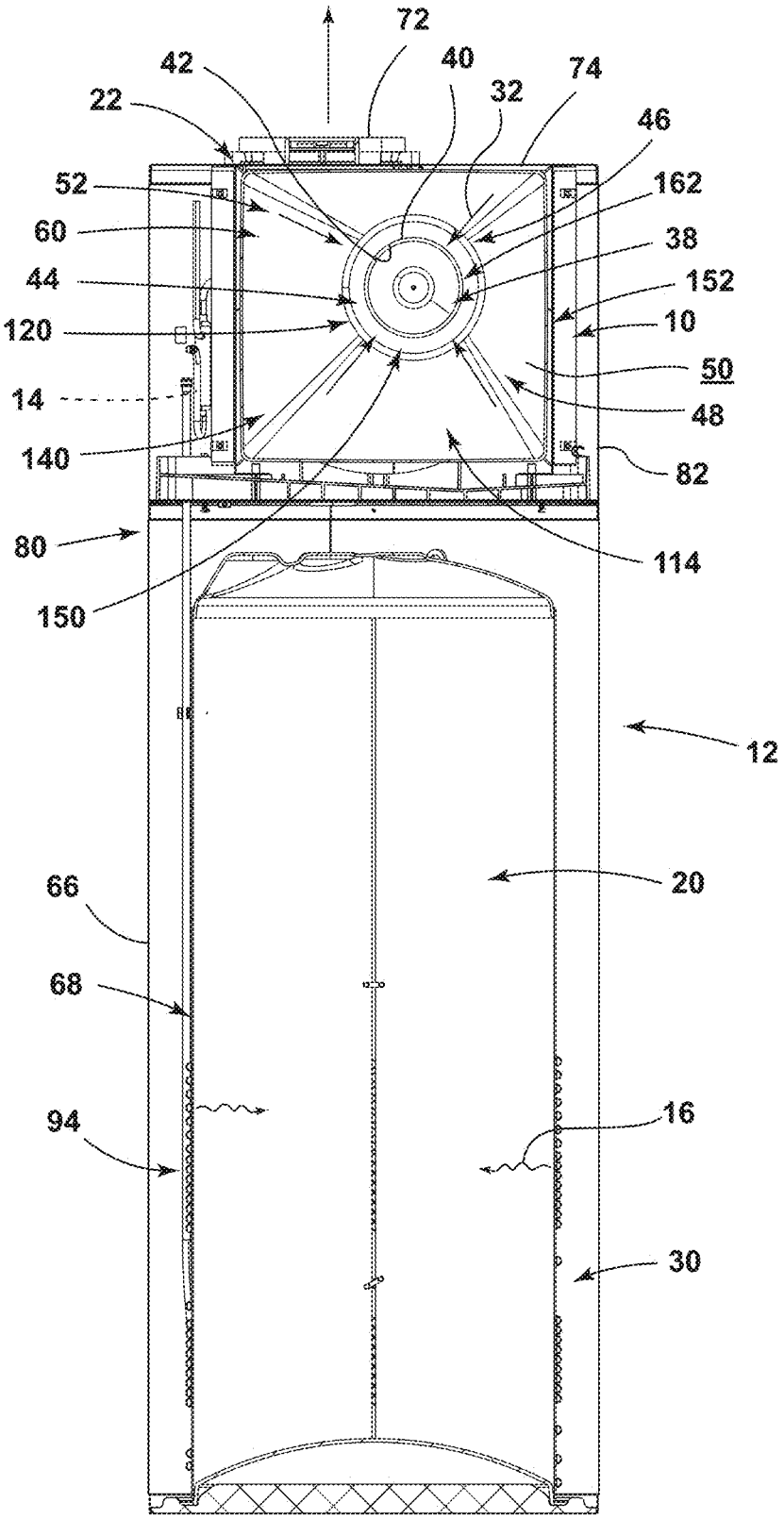
FIG. 4 is a cross-sectional view of the water heater of FIG. 2 taken along the line IV-IV.
Figure 5:
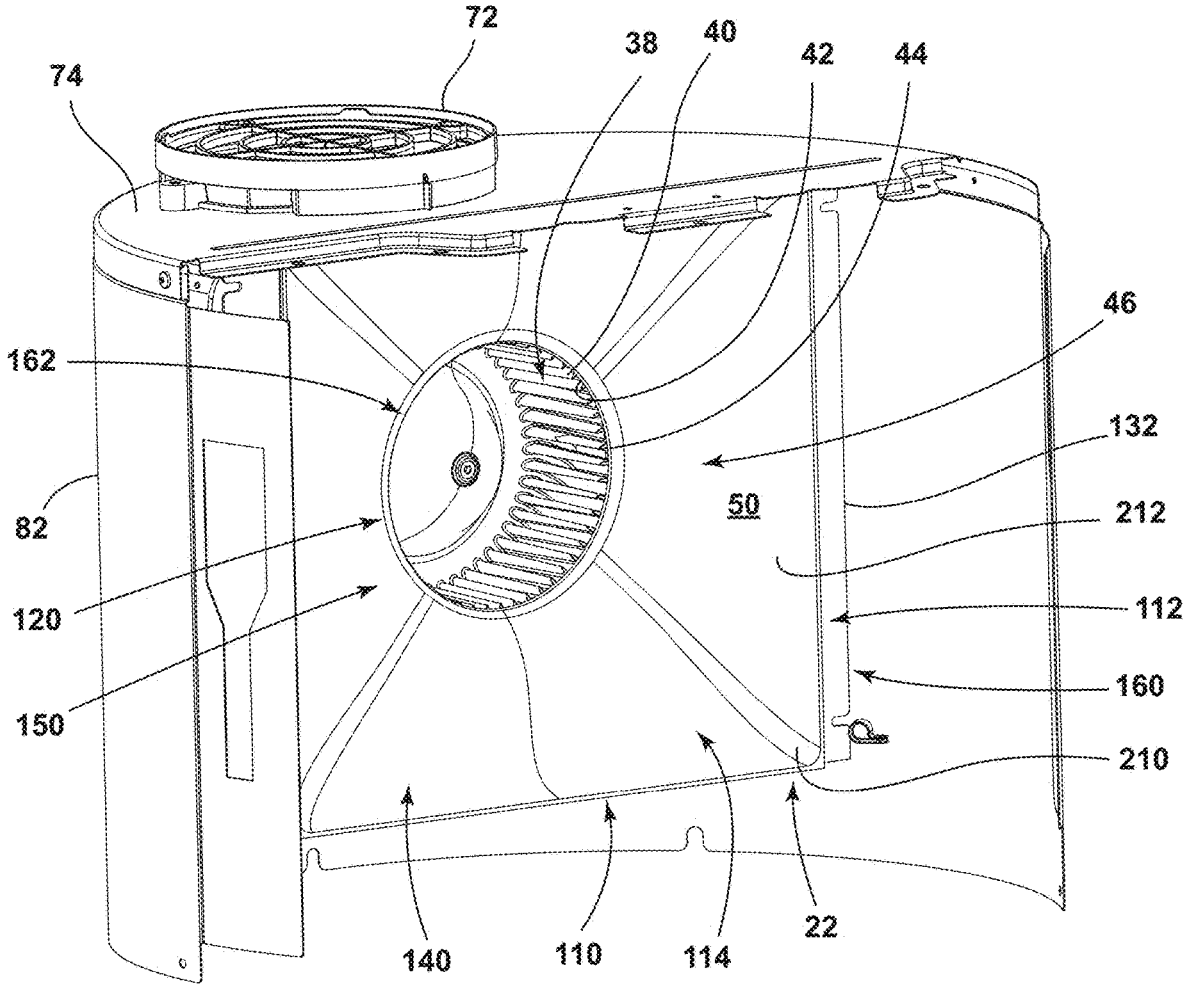
FIG. 5 is a perspective view of the upper housing of the water heater of FIG. 1, and showing engagement of an aspect of the air funnel with the upper housing.

For purposes of description herein, the terms "upper," "lower," "right," "left," "rear," "front," "vertical," "horizontal," and derivatives thereof shall relate to the concepts as oriented in FIG. 1. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present illustrated embodiments reside primarily in combinations of method steps and apparatus components related to an air funnel for a heat pump system that extends between a heat exchanger and a blower for generating a converging flow of process air through the air funnel and contemporaneously maintaining a consistent and even air pressure and air velocity of the process air as it moves through the heat exchanger and converges into a port of the air funnel for directing the process air into the blower for the heat pump system. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Referring to FIGS. 1-17, reference numeral 10 generally designates a heat pump system incorporated within a water heater 12, where the heat pump system 10 utilizes a heat exchange media 14 for transferring heat 16 collected within an evaporator 18 and into water 20 that is to be heated. The heat pump system 10 can be utilized within a tank-type water heater 12, or within a tankless-type water heater 12. Additionally, certain hybrid configurations of water heaters 12 can utilize the heat pump system 10 that may include a reservoir 68 of heated water 20, as well as a tankless-component of a water heater 12.

As exemplified in FIGS. 1-17, the water heater 12 can include the heat pump system 10 that includes a heat exchanger 30, typically an evaporator 18, for absorbing heat 16 from process air 32. The heat 16 extracted by the heat exchanger 30 is delivered into a heat exchange media 14. The evaporator 18 includes an outer perimeter 34 that defines a first dimension 36. A blower 38 selectively draws the process air 32 through the heat exchanger 30. The blower 38, which is driven by a motor 56, operates to move the process air 32 through the heat exchanger 30. An air funnel 22 extends between the outer perimeter 34 of the heat exchanger 30 and the blower 38. The air funnel 22 includes a rounded port 40 having an inner circumference 42 that defines a second dimension 44. The second dimension 44 is smaller than the first dimension 36. In this manner, the air funnel 22 provides for a convergence 46 of the flow 48 of process air 32 leaving the heat exchanger 30 and moving through the port 40 of the air funnel 22 and into the blower 38. The air funnel 22 includes an inner surface 50 that maintains an air pressure 52 of the process air 32 to be generally consistent within the heat exchanger 30. Typically, the heat exchanger 30 includes a rectilinear shape and the port 40 includes a generally rounded, and typically circular, configuration. Accordingly, the air funnel 22 manipulates the flow 48 of process air 32 to converge from the larger size of the rectangular heat exchanger 30 into the smaller generally circular shape of the port.

According to the various aspects of the device, as exemplified in FIGS. 1-17, the air funnel 22 is configured to maintain a consistent air pressure 52 and air velocity 60 within the heat exchanger 30. Therefore, to maximize the capture of heat 16 from within the heat exchanger 30, the consistent movement of process air 32 throughout the entirety of the heat exchanger 30 serves to increase the efficiency of the heat pump system 10 delivering heat 16 into the water 20 to be heated. The air funnel 22, as will be described more fully below, includes a series of sections that operate sequentially to maintain the substantially consistent air pressure 52 within the heat exchanger 30, and to also maintain a substantially consistent decline of air pressure 52 of the process air 32 as it moves between a downstream surface 62 of the heat exchanger 30 and through the port 40 of the air funnel 22 and into the blower 38. Accordingly, the process air 32 moving between an upstream surface 64 of the heat exchanger 30 and the downstream surface 62 of the heat exchanger 30 maintains a consistent and even air pressure 52 and air velocity 60. This configuration minimizes the occurrence of a pressure drop of the process air 32 within the heat exchanger 30. In this manner, the entirety of the heat exchanger 30 is utilized for transferring heat 16 from the process air 32 and into a heat exchange media 14 moving through the evaporator 18 of the heat pump system 10.

Referring again to FIGS. 1-6 and 9-12, the heat exchanger 30 includes an outer housing 80 that encloses the various components of the water heater 12. As exemplified in FIGS. 1-6, the water heater 12 includes an upper housing 82 that encloses components of the heat pump system 10. The housing also includes a lower housing 66 that encloses a reservoir 68 for storing water 20 and maintaining the temperature of the heated water 20. The upper housing 82 of the water heater 12 includes an air inlet 70 and an air outlet 72 that are each positioned, typically, within a top wall 74 of the upper housing 82. These apertures provide for the expedient movement of process air 32 through the upper housing 82 to be acted upon by the evaporator 18 of the heat pump system 10.

Referring now to FIGS. 2-6 and 9-12, the heat pump system 10 includes the evaporator 18 that receives a heat exchange media 14 typically from an expansion device 90. The heat exchange media 14 leaving the evaporator 18 is heated and is directed to a compressor 92. The heat exchange media 14 leaving the compressor 92 is pressurized and heated and typically in the form of a gas. This form of the heat exchange media 14 is then directed to a condensing portion 94 of the heat pump system 10 where heat 16 is rejected into a separate media. In the case of the water heater 12, the condensing portion 94 is typically in the form of the reservoir 68 of water 20 to be heated, or a conduit of water 20 that is heated as it moves through the condensing portion 94 of the heat pump system 10. After leaving the condensing portion 94 of the heat pump system 10, the heat exchange media 14 is delivered to the expansion device 90 where the heat exchange media 14 is now cooled in liquid form. This cooled liquid form of the heat exchange media 14 is then delivered to the evaporator 18 of the heat pump system 10 to receive additional amounts of heat 16 that can then be transferred to the condensing portion 94 of the heat pump system 10. This process continues to move heat 16 from the process air 32 to the water 20 within the reservoir 68.

Typically, the compressor 92, evaporator 18, and expansion device 90 are located within the upper housing 82 of the water heater 12. The condensing portion 94 of the heat pump system 10 is located in the lower housing 66 proximate the reservoir 68 of water 20 to be heated. Other locations of these components are also contemplated.

Referring now to FIGS. 3-6 and 9-12, the evaporator 18 of the heat pump system 10 is positioned adjacent to the blower 38 such that process air 32 can move through the evaporator 18. In this configuration, heat 16 is extracted from the process air 32 and delivered into the heat exchange media 14 moving through the evaporator 18. The even movement of process air 32 through the evaporator 18, which is generated by the air funnel 22, ensures that the process air 32 moves through the evaporator 18 in an even and consistent rate. In this manner, a maximum amount of heat 16 can be extracted from the process air 32 and delivered into the heat exchange media 14.

It is contemplated that the heat exchange media 14 can be in the form of a refrigerant, water, air, glycol, and other similar substances that are effective at absorbing and releasing heat 16 within a heat pump system 10.

Referring now to FIGS. 3-17, the air funnel 22 that is attached to the evaporator 18 includes a transition section 110 that engages the heat exchanger 30. This transition section 110 includes a pressure maintenance portion 112 and a pressure regulation portion 114. The pressure maintenance portion 112 of the air funnel 22 is positioned around the heat exchanger 30 such that the pressure maintenance portion 112 operates to maintain the air pressure 52 and air velocity 60 of the process air 32 moving through the heat exchanger 30 to be at a consistent rate. The pressure regulation portion 114 of the transition section 110 operates on the process air 32 to manage the transfer of the process air 32 between the downstream surface 62 of the heat exchanger 30 and the port 40 that leads into the blower 38. The geometry of this pressure regulation portion 114 of the air funnel 22 collects the flow 48 of process air 32 and generates a consistent and even decrease in air pressure 52, as well as a consistent and even increase in air velocity 60, of the process air 32. This phenomena is commonly referred to as a Venturi effect that is caused by a narrowing of a flow of a media moving through a space. The pressure regulation portion 114 of the air funnel 22 manages the Venturi effect to ensure that as the process air 32 moves through the pressure regulation portion 114, each section of the flow 48 of process air 32 experiences a similar decrease in air pressure 52 and increase in air velocity 60 as it approaches the port.

Referring again to FIGS. 3-17, the air funnel 22 also includes a convergence section 120 that forms the rounded port 40 that directs the process air 32 into the blower 38. This convergence section 120 of the air funnel 22 directs the process air 32 from the transition section 110 and into the inner perimeter of the port. Once through the port, the process air 32 is moved by the blower 38 through the air outlet 72 and out of the upper housing 82.

Referring again to FIGS. 5-17, the pressure maintenance portion 112 of the air funnel 22 extends across the depth 130 of the heat exchanger 30 between the upstream surface 64 of the heat exchanger 30 and the downstream surface 62 of the heat exchanger 30. It is contemplated that this pressure maintenance portion 112 is substantially rectangular to match the profile of the heat exchanger 30. In certain aspects of the device, the pressure maintenance portion 112 can also extend at least partially into the space of the air funnel 22 that is immediately adjacent to the downstream section of the heat exchanger 30. This pressure maintenance portion 112 of the air funnel 22 is typically defined by a flange 132 of the air funnel 22 that engages the rectangular outer edge 134 of the heat exchanger 30. This flange 132 can engage a single surface to the heat exchanger 30. Additionally, the flange 132 can extend around multiple surfaces of the outer edge 134 of the heat exchanger 30 to encircle a portion of the heat exchanger 30 or the entirety of the outer edge 134 of the heat exchanger 30. The flange 132 of the pressure maintenance portion 112 operates to secure the air funnel 22 to the heat exchanger 30 while also providing a guide through which the process air 32 is directed through the heat exchanger 30 at a consistent and even air pressure 52 and air velocity 60.

The pressure regulation portion 114 of the air funnel 22 includes a concave shape that is positioned immediately adjacent to the downstream surface 62 of the heat exchanger 30. This pressure regulation portion 114 includes a cross-sectional profile that is generally in the shape of a parabolic arc that proceeds from the rectangular downstream surface 62 of the heat exchanger 30 and toward the circular convergence section 120 of the air funnel 22. This parabolic curvature of the pressure regulation portion 114 operates to gradually and evenly decrease the air pressure 52 of the process air 32, thereby managing the Venturi effect within the air funnel 22. Additionally, the pressure regulation portion 114 manipulates the flow 48 of process air 32 between the rectangular configuration of the heat exchanger 30 and the round configuration of the convergence section 120.

By managing the Venturi effect, sections of the flow 48 of process air 32 are prevented from moving at a greatly accelerated rate or decelerated rate, relative to adjacent portions of the flow 48 of process air 32. Undesirable isolated changes in air pressure 52 and air velocity 60 may result in a section of the process air 32 that experiences a pressure drop. These sections of pressure drop within the process air 32 can have impact upstream that may result in an uneven flow 48 of process air 32 through the heat exchanger 30.

Referring again to FIGS. 7-17, the pressure regulation portion 114 of the transition section 110 moves into the convergence section 120 of the air funnel 22 and transitions from the concave portion 140 of the air funnel 22 to a convex portion 150 of the air funnel 22. This convex portion 150 of the convergence section 120 of the air funnel 22 further directs the flow 48 of process air 32 through the port 40 and into the blower 38. Again, this transition of the air funnel 22 between the pressure regulation portion 114 and convergence section 120 of the air funnel 22 maintains a consistent and even decrease of air pressure 52, as well as a consistent and even increase in air velocity 60 as the flow 48 of process air 32 moves through the port 40 and into the blower housing 172.

In certain aspects of the device, the convergence section 120 of the air funnel 22 can be positioned in an eccentric position with respect to the transition section 110. Stated another way, the convergence section 120 and the port 40 can be positioned in an off-axis or off-center position within the air funnel 22 with respect to the transition section 110 as well as the heat exchanger 30. In this configuration, as described more fully herein, the curvature of the concave portion 140 of the pressure regulation portion 114 directs the process air 32 to maintain the consistent and even increase in air velocity 60, and corresponding decrease in air pressure 52. This eccentric position of the port 40 serves to align the port with the rotational axis of a fan 58 of the blower 38 to funnel the process air 32 directly into the middle of the blower 38. This configuration further minimizes turbulence and isolated changes in the air pressure 52 and the air velocity 60.

To accommodate the off-center position of the port 40, the pressure regulation portion 114 includes a non-symmetrical curvature of the concave portion 140. This non-symmetrical configuration of the concave portion 140 directs the process air 32 in a consistent increase in air velocity and corresponding decrease in air pressure 52. In this manner, the curvature of the concave portion 140 can define a steeper curve on the short side of the air funnel 22. The short side being that side of the air funnel 22 where the port 40 is closer to the outer edge 134 of the heat exchanger 30. Similarly, the long side of the air funnel 22, that portion of the concave portion 140 where the port 40 is farther from the outer edge 134 of the heat exchanger 30, can have a shallower curve.

In certain aspects of the device, the port 40 and the convergence section 120 can be centrally located within the air funnel 22. In such a configuration, the fan 58 of the blower 38 is also centrally located within the air funnel 22.

According to the various aspects of the device, whether the port 40 is eccentrically positioned or centrally positioned, it is typically contemplated that the convergence section 120 of the air funnel 22 is symmetrical about the port 40.

Figure 8:
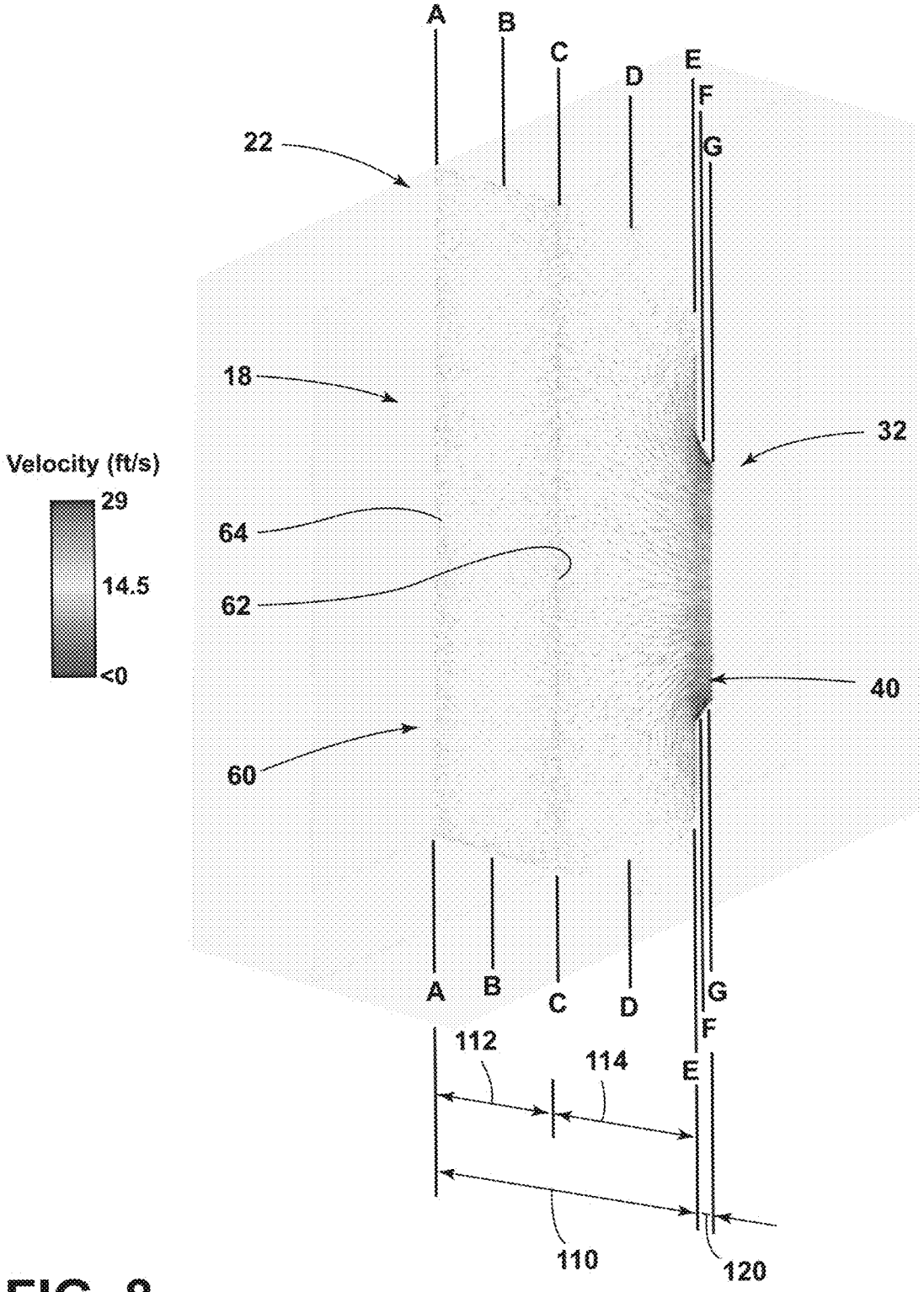
FIG. 8 is a schematic diagram illustrating airflow velocity of process air moving through the air funnel of FIG. 6.
Figure 9:
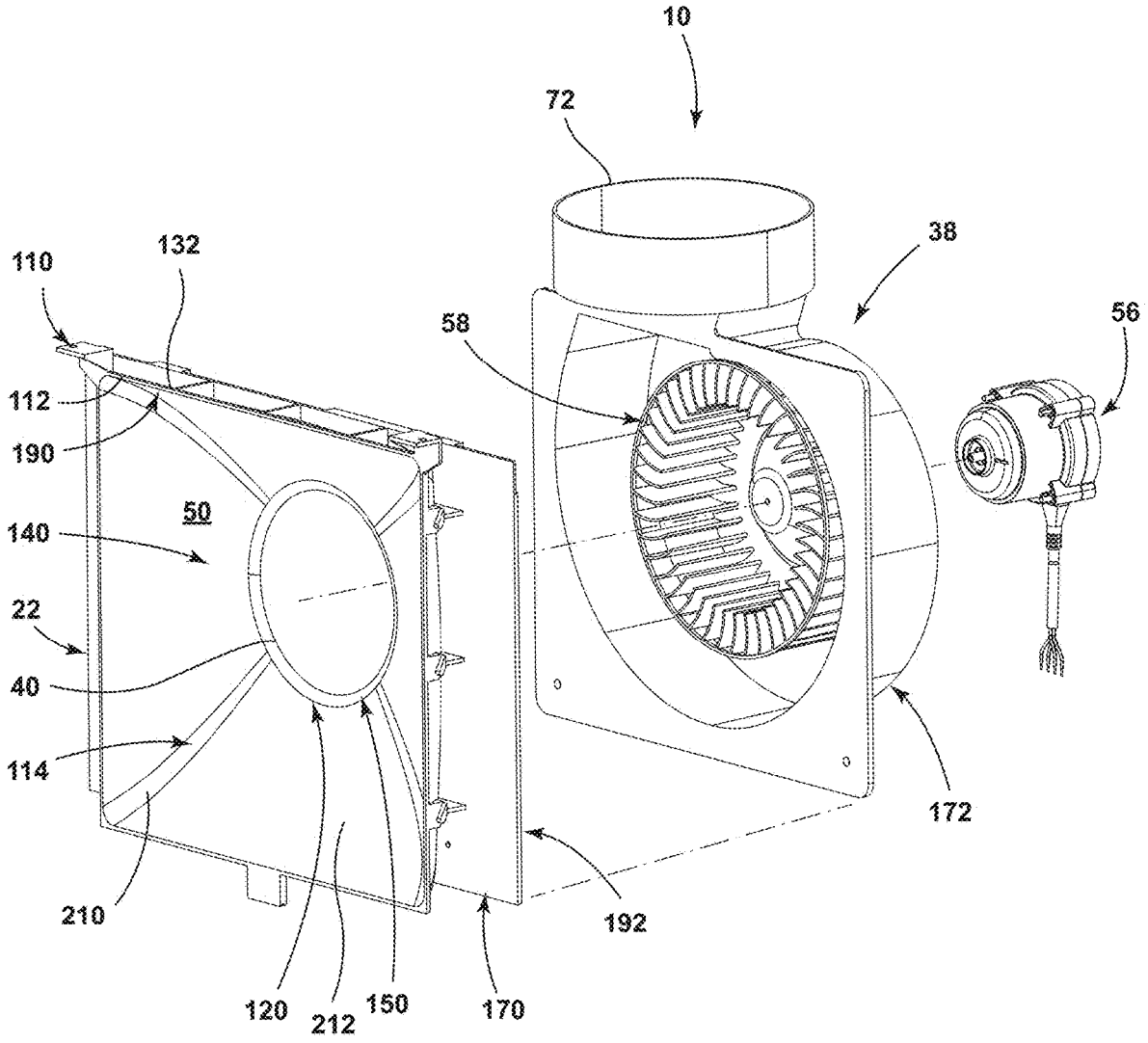
FIG. 9 is an exploded perspective view of the heat pump system of FIG. 7.
Figure 10:
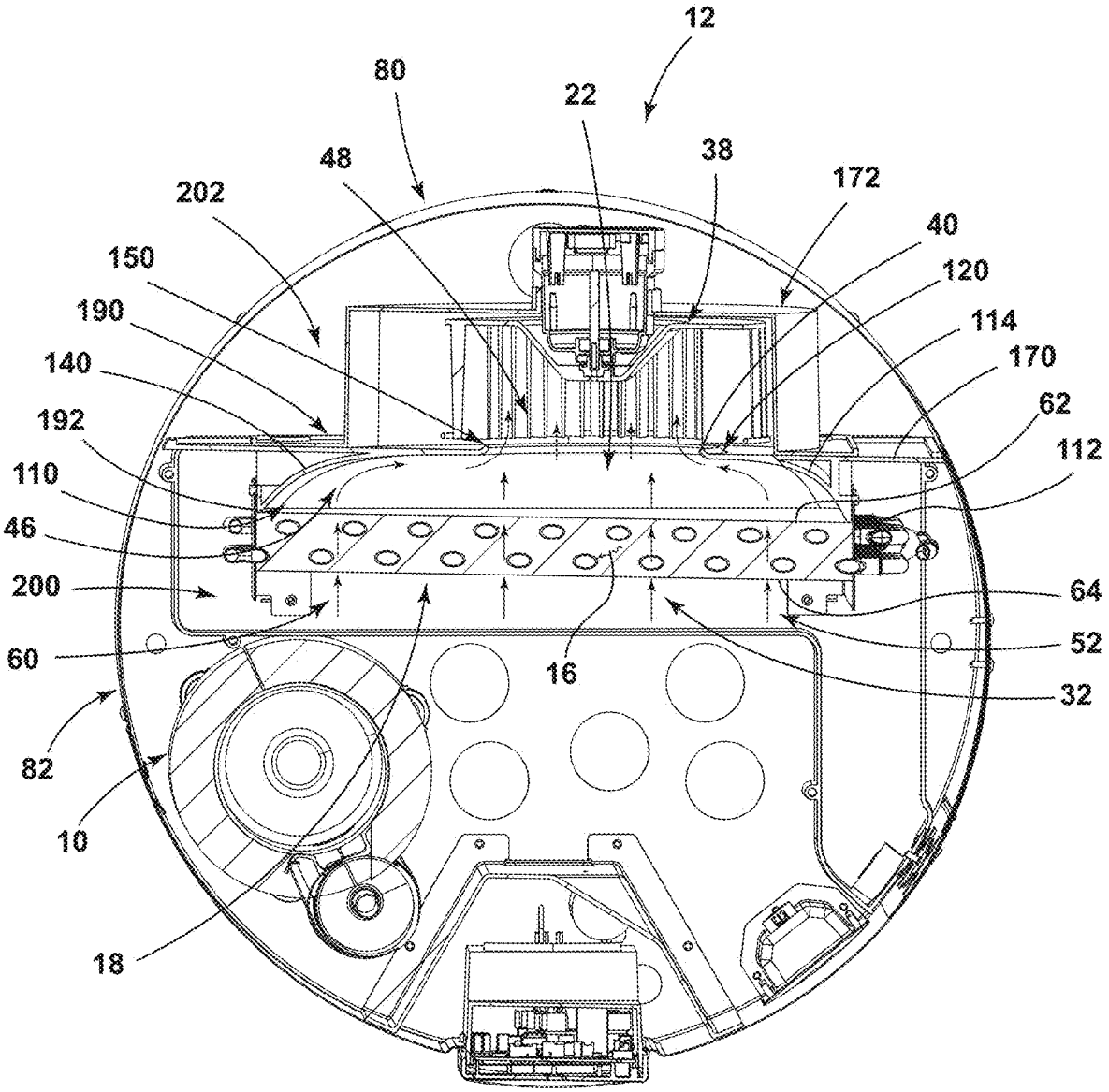
FIG. 10 is a cross-sectional view of the water heater of FIG. 1 taken along the line X-X.
Figure 11:
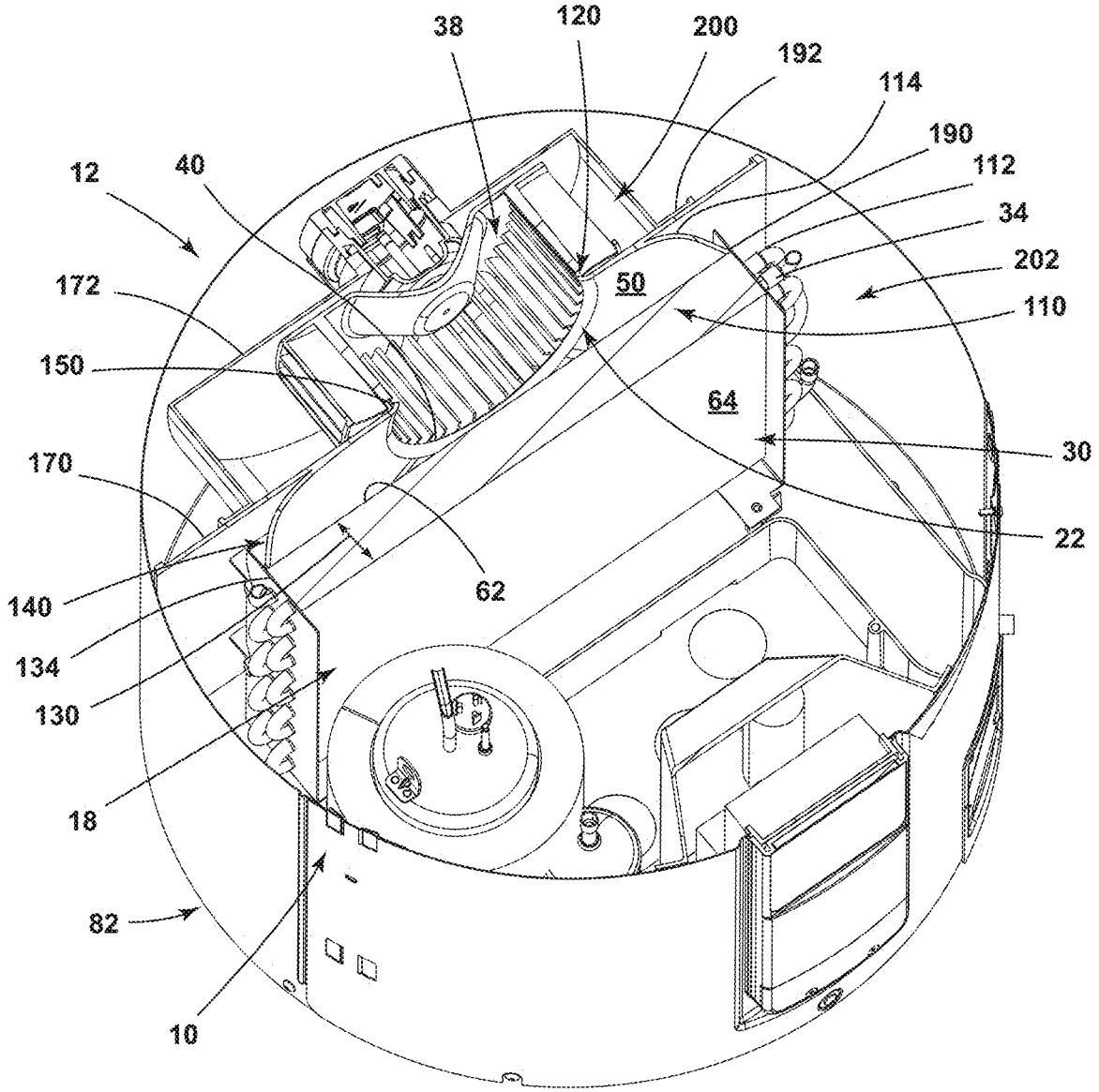
FIG. 11 is a perspective cross-sectional view of the heat pump system of FIG. 10.
Figure 12:
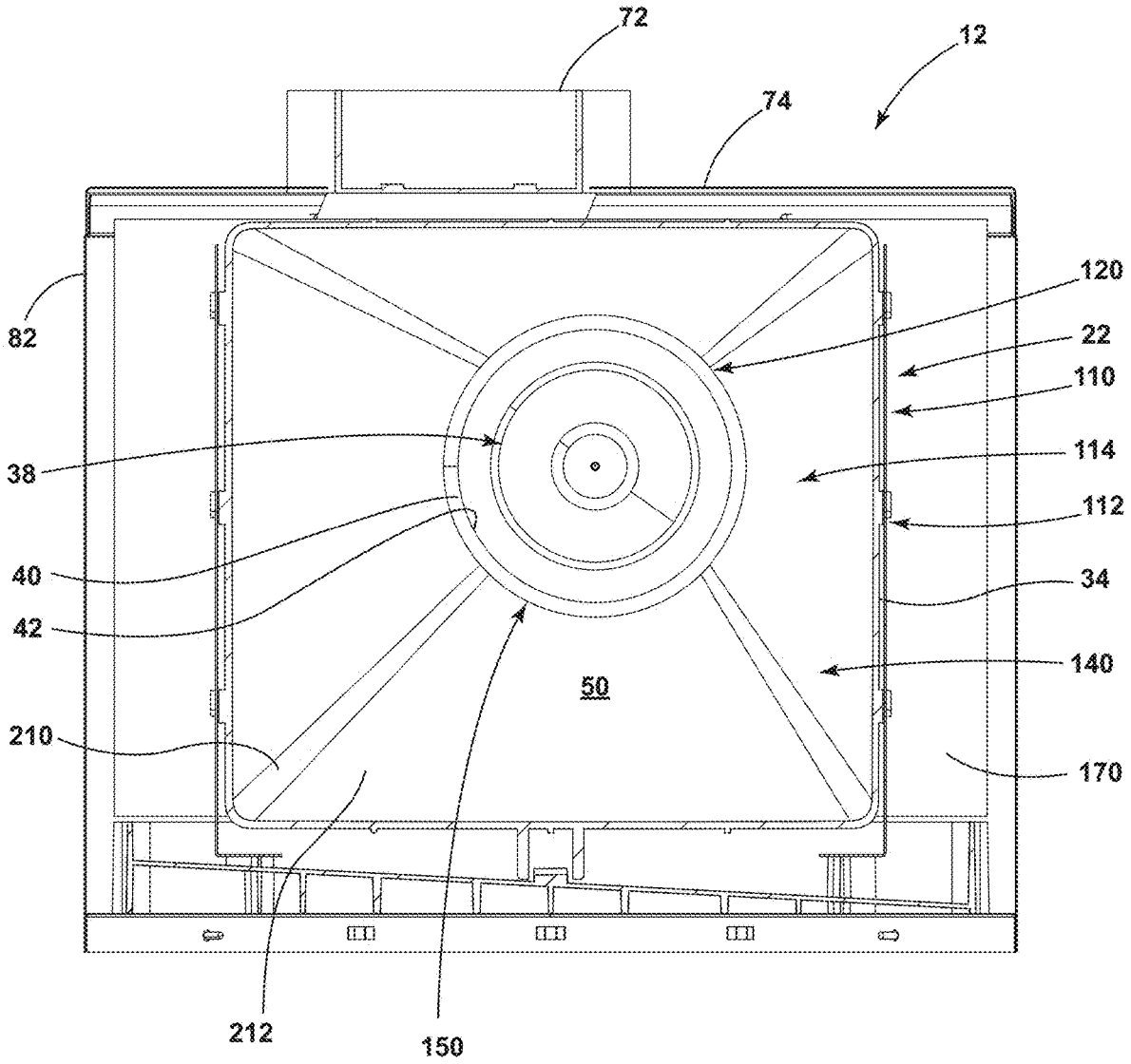
FIG. 12 is a cross-sectional view of the heat pump system of FIG. 9.
Figure 13:
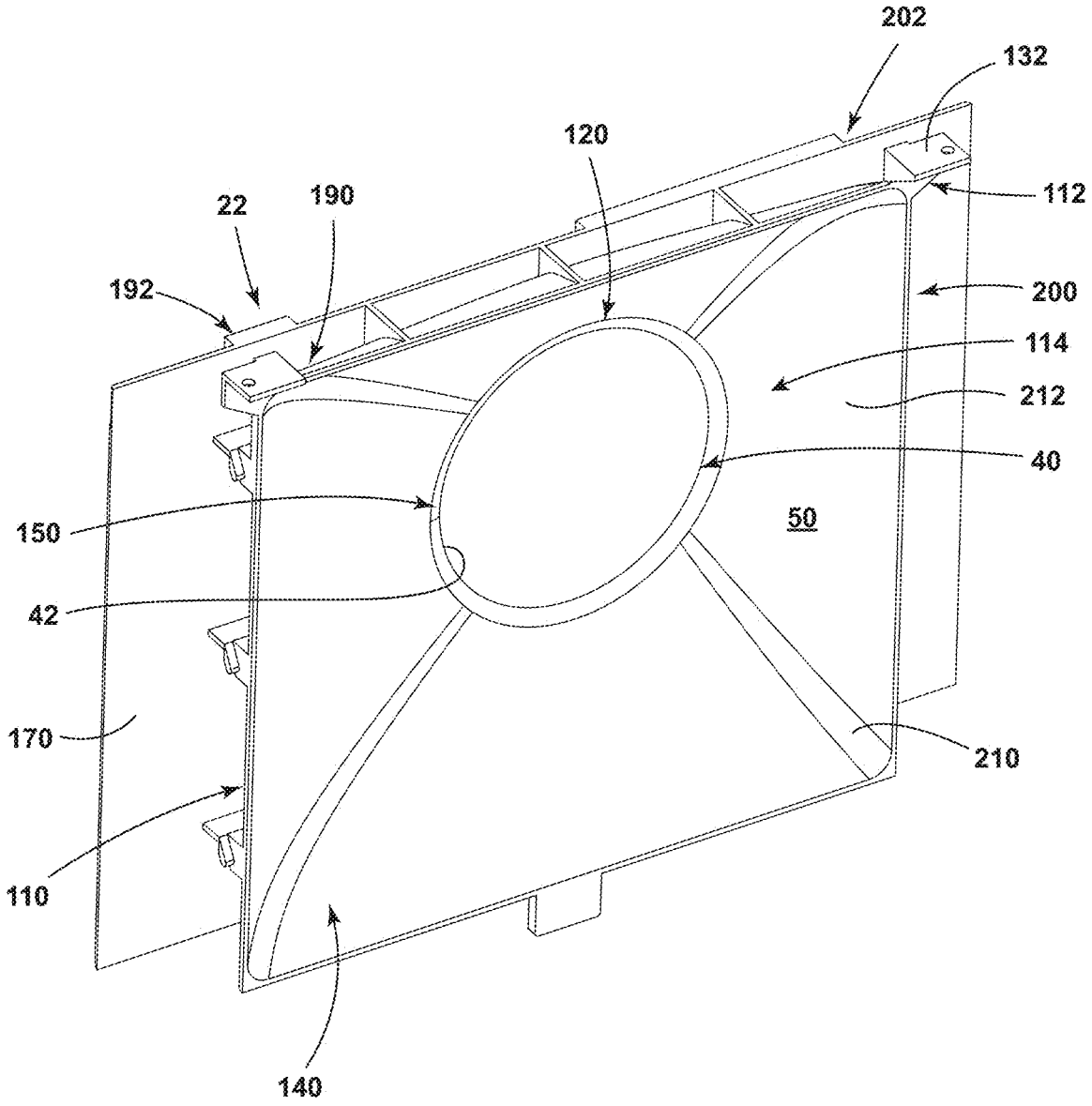
FIG. 13 is a perspective view of an aspect of the air funnel of FIG. 9 that can incorporate within a heat pump system for a water heater.
Figure 14:
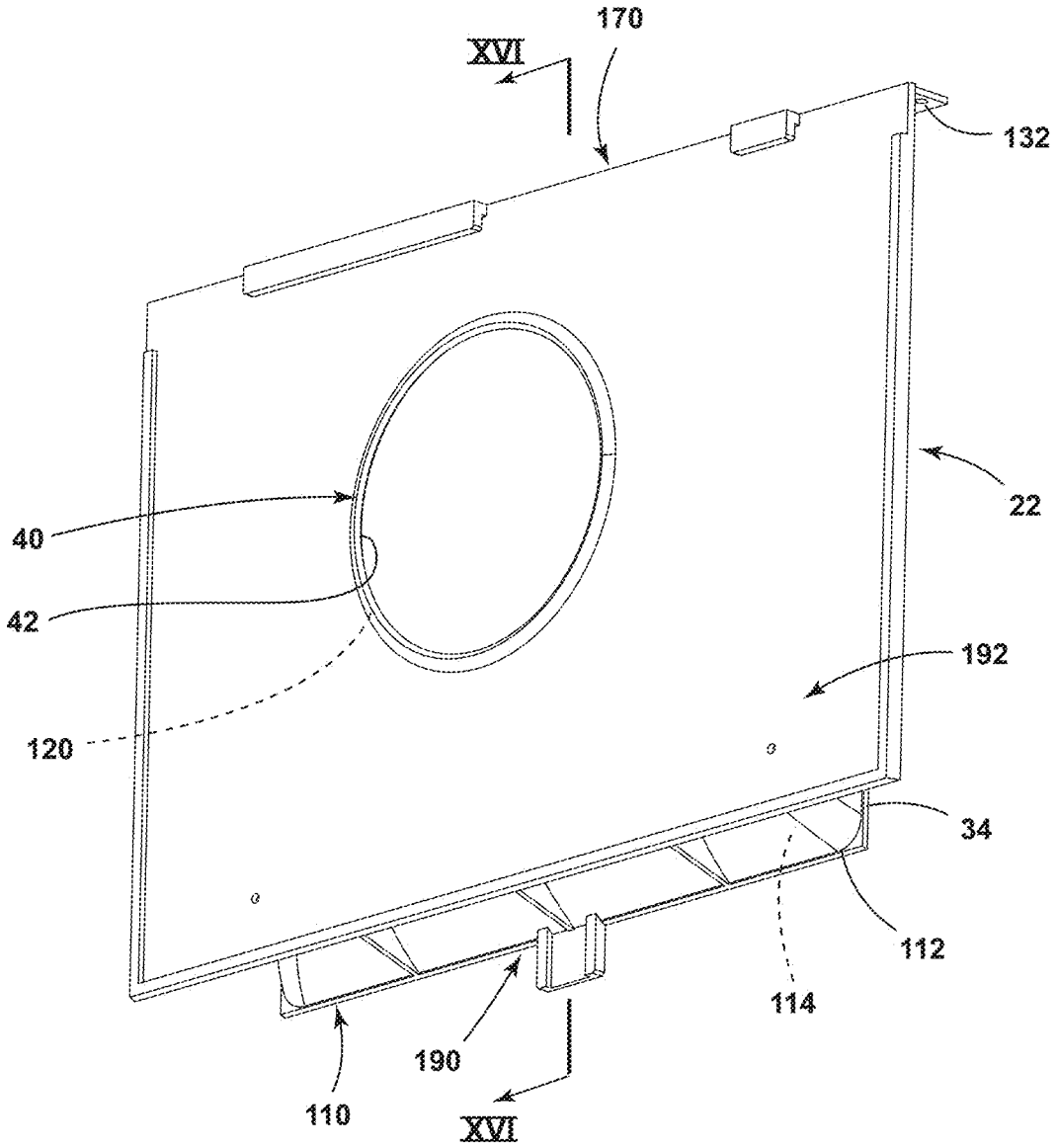
FIG. 14 is a second perspective view of the air funnel of FIG. 13.
Figure 15:
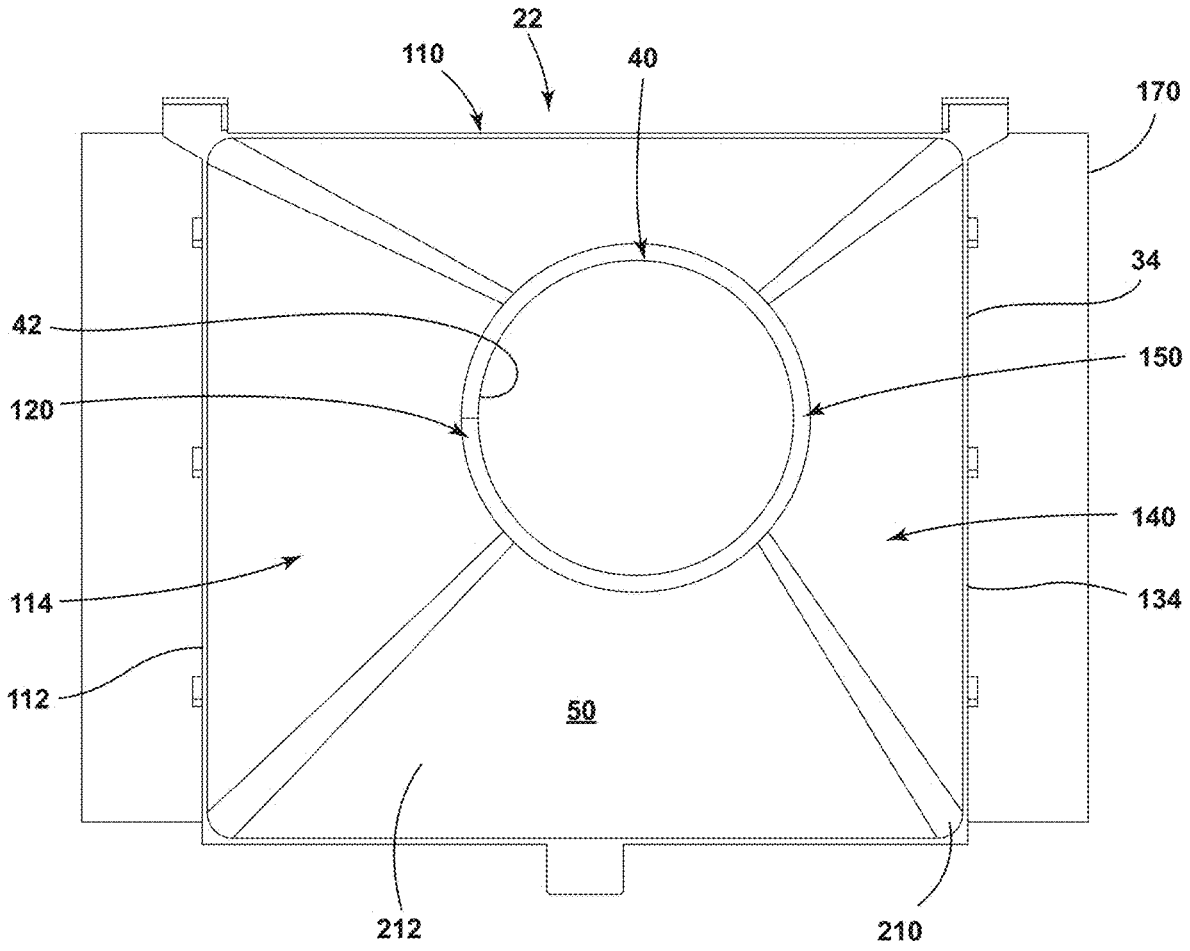
FIG. 15 is a side elevational view of the air funnel of FIG. 13.
Figure 16:
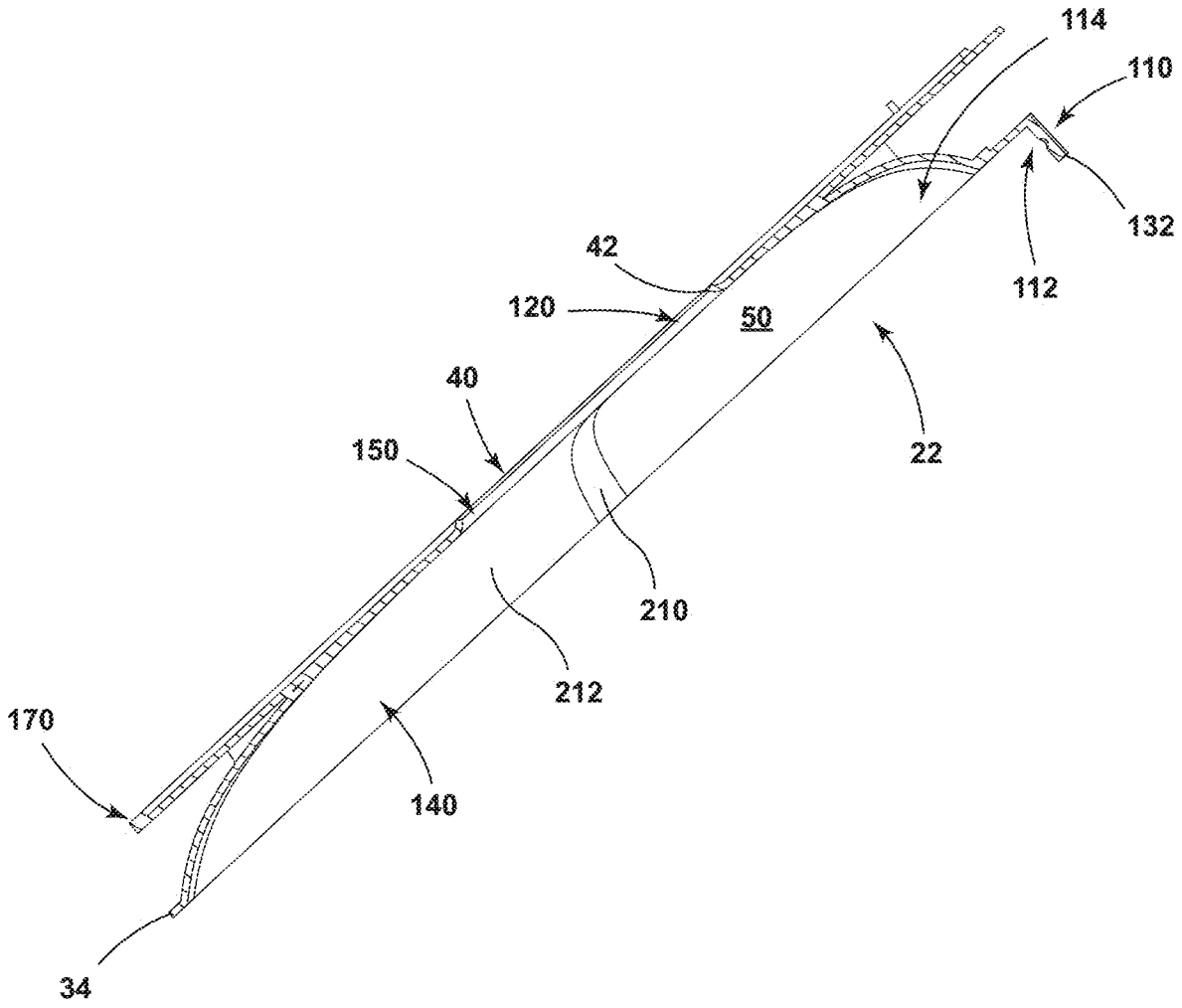
FIG. 16 is a cross-sectional view of the air funnel of FIG. 14, taken along line XVI-XVI.
Figure 17:
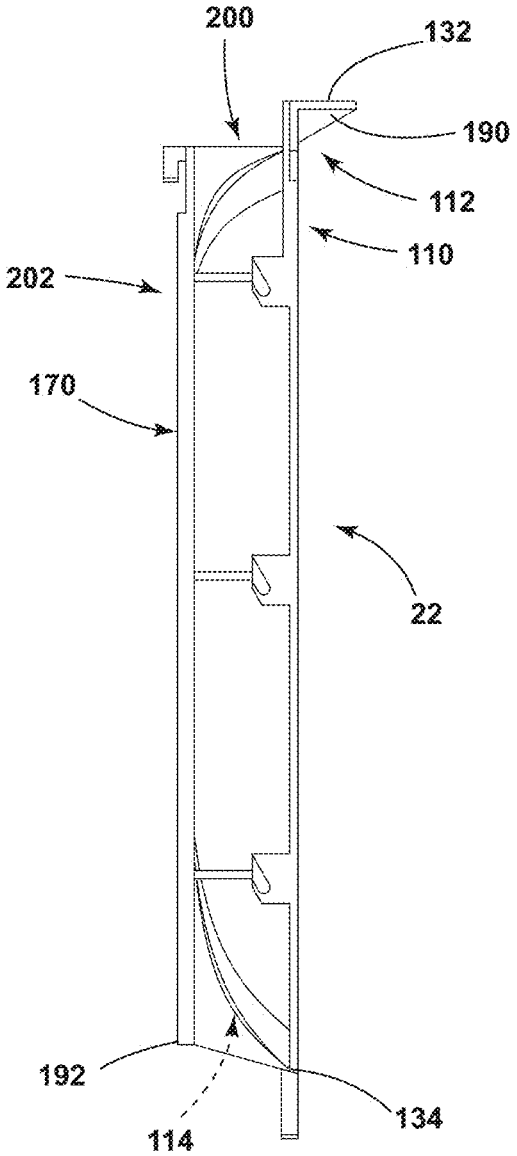
FIG. 17 is a side elevational view of the air funnel of FIG. 13.

As exemplified in FIG. 8, the configuration of the air funnel 22 exemplified herein is modeled, showing the consistent and even increase in air velocity 60 between the downstream surface 62 of the heat exchanger 30 and port 40 of the blower 38. As shown in this model, the various annotated benchmarks A-G show the velocity of the process air 32 moving through the air funnel 22 to be substantially consistent across each benchmark. The benchmarks A-C show the consistent velocity of the process air 32 within the area of the evaporator 18 and the pressure maintenance portion 112. The benchmarks D-G show the gradual and consistent increase in air velocity 60 as the process air 32 moves through the pressure regulation portion 114 and the convergence section 120. Again, this increase in air velocity 60 of the process air 32 coincides with a corresponding consistent decrease in air pressure 52 as the process air 32 moves across the air funnel 22 between the pressure maintenance portion 112, the pressure regulation portion 114, and the convergence section 120. Accordingly, the configuration of the air funnel 22 serves to converge the flow 48 of process air 32 from the heat exchanger 30 and to the port 40 in an even configuration that results in a consistent decrease in air pressure 52 and increase in air velocity 60 of the process air 32 as it moves through the air funnel 22.

Referring again to FIGS. 3-17, an airflow system 152 for a water heater 12 includes the heat exchanger 30, typically in the form of the evaporator 18, that draws heat 16 from the process air 32. The heat exchanger 30 delivers the heat 16 to the heat exchange media 14. Typically, the heat exchanger 30 includes a rectilinear cross-section that defines a first area 160. The blower 38 delivers the process air 32 through the heat exchanger 30. The blower 38 operates to deliver the process air 32 through the heat exchanger 30. The air funnel 22 directs the process air 32 from the heat exchanger 30 into the blower 38. The air funnel 22 includes a rounded port 40 with an inner perimeter that defines a second area 162. This second area 162 is smaller than the first area 160 such that the flow 48 of process air 32 needs to be converged between the downstream surface 62 of the heat exchanger 30 and the port. The port 40 directs the process air 32 from the air funnel 22 and into the blower 38. The air funnel 22 manages the air pressure 52 of the process air 32 to be consistent within the heat exchanger 30. Additionally, the air funnel 22 regulates the air pressure 52 of the process air 32 to decrease evenly and consistently between the downstream surface 62 of the heat exchanger 30 and the rounded port 40 of the air funnel 22. As discussed herein, the pressure maintenance portion 112 of the air funnel 22 maintains the air pressure 52 of the process air 32 to be consistent within the heat exchanger 30. The pressure regulation portion 114 of the air funnel 22 manipulates the process air 32 to gradually and evenly decrease the air pressure 52 of the process air 32 between the rectangular pressure maintenance portion 112 and the circular convergence section 120 of the air funnel 22.

Referring again to FIGS. 3-17, the heat pump system 10 for the water heater 12 includes the evaporator 18 that draws heat 16 from the process air 32. The heat exchanger 30 delivers this heat 16 to the heat exchange media 14. The heat exchanger 30 includes a generally rectilinear cross-section that defines the first area 160. The blower 38 delivers the process air 32 through the evaporator 18. The air funnel 22 at least partially surrounds the outer edge 134 of the evaporator 18 and directs the process air 32 from the evaporator 18 to the circular port 40 of the air funnel 22. The circular port 40 includes an inner circumference 42 that defines the second area 162. The second area 162 is smaller than the first area 160. The air funnel 22 manages the air velocity 60 of the process air 32 to be even and consistent within the heat exchanger 30. The air funnel 22 also regulates the air velocity 60 of the process air 32 to define a consistent increase in air velocity 60 as the process air 32 moves between the downstream surface 62 of the evaporator 18 and the circular port 40.

Referring again to FIGS. 7 and 9-17, the air funnel 22 includes the flange 132 that engages the heat exchanger 30 of the heat pump system 10. The air funnel 22 also includes a plate 170 that engages a blower housing 172 of the blower 38. This plate 170 typically mimics the shape of the blower housing 172. As exemplified herein, the blower housing 172 can include a generally cochlear shape. Accordingly, the plate 170 of the air funnel 22 includes a similar cochlear profile to securely engage the blower housing 172.

Figure 6:
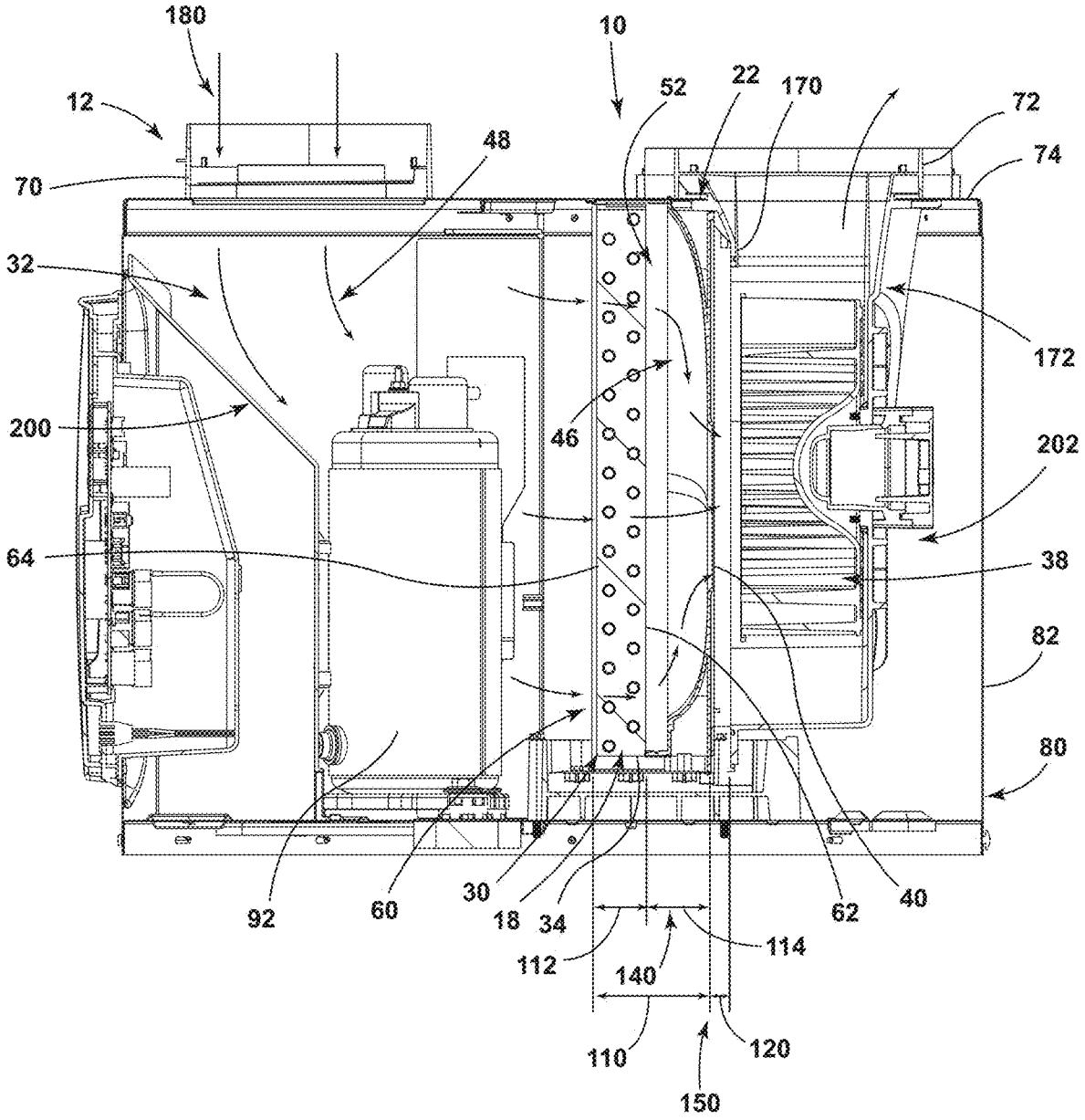
FIG. 6 is a partial cross-sectional view of the water heater of FIG. 2 taken along the line VI-VI, and showing portions of the heat pump system contained within the upper housing.
Figure 7:
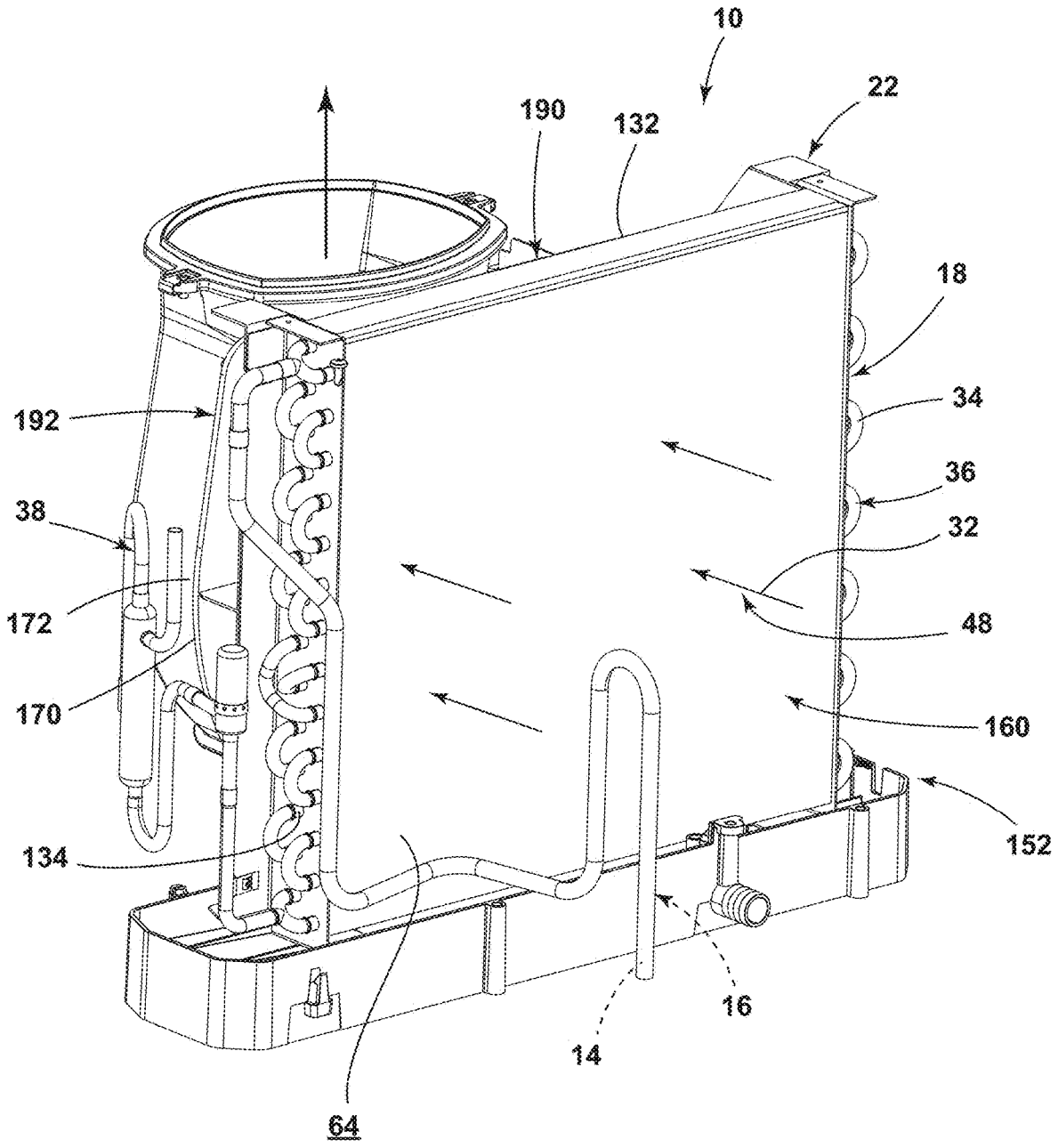
FIG. 7 is a schematic perspective view of an aspect of the heat pump system incorporated within a water heater.

As exemplified in FIGS. 6 and 7, during operation of the heat pump system 10, the blower 38 activates to move process air 32 through the evaporator 18. Ambient air 180 from the air inlet 70, in the form of process air 32, is directed into the evaporator 18. As discussed herein, the process air 32 and the movement of the flow 48 of process air 32 through the heat exchanger 30 is managed by the air funnel 22. Again, the air funnel 22 maintains the flow 48 of process air 32 to be consistent and even through the heat exchanger 30 to minimize or eliminate pressure drop within the heat exchanger 30. This, in turn, also maintains the velocity of the flow 48 of process air 32 through the heat exchanger 30 to be even and consistent.

Referring again to FIGS. 6 and 7, after leaving the heat exchanger 30, the flow 48 of process air 32 is now cooled process air 32 that moves through the air funnel 22 and to the port, where the process air 32 is directed into the blower housing 172. It is contemplated that the plate 170 of the air funnel 22 defines the port 40 for the blower housing 172. This plate 170 can be formed as an integral part of the air funnel 22 or can be a separate component that is attached to the air funnel 22.

The convergence section 120 of the air funnel 22 transitions between the pressure regulation portion 114 of the air funnel 22 and the port 40 of the air funnel 22 and directs the flow 48 of process air 32 through the convex configuration of the convergence section 120 to direct the flow 48 of process air 32 into the blower housing 172. Stated another way, the air funnel 22 regulates the flow 48 of process air 32 through the heat exchanger 30, and also through the space between the heat exchanger 30 and the blower housing 172 that is defined by the inner surface 50 of the air funnel 22. Accordingly, the flow 48 of process air 32 is managed by the air funnel 22 to be an even and consistent flow 48 of process air 32 that moves through the port 40 and is directed into the blower housing 172.

Referring again to FIGS. 6 and 7, this cooled process air 32 is then directed out of the upper housing 82 for the water heater 12 through operation of the blower 38. This now cooled process air 32 can be directed out of the top panel for the housing and directed to a downstream area for expulsion from a space or recapture for later use.

Referring again to FIGS. 5-7 and 9-17, the air funnel 22 includes a first attachment section 190, in the form of the flange 132, that attaches to the heat exchanger 30. The air funnel 22 includes a second attachment section 192, in the form of the plate 170, that attaches to the blower housing 172. Each of the first attachment section 190 and the second attachment section 192 of the air funnel 22 assist in managing the movement of the flow 48 of process air 32 through the air funnel 22 to be even and consistent through the various sections of the air funnel 22. In the case of the pressure maintenance portion 112 of the air funnel 22, the air funnel 22 maintains the flow 48 of process air 32 to be even and consistent through the heat exchanger 30 to minimize variations in the air pressure 52 as well as variations in the air velocity 60. As the flow 48 of process air 32 moves through the pressure regulation portion 114 of the air funnel 22, the inner surface 50 of the air funnel 22 manages the decline of air pressure 52 and the increase in air velocity 60 to be even and consistent as the flow 48 of process air 32 moves toward the port. Moreover, as the flow 48 of process air 32 moves through the port, this flow 48 of process air 32 is again maintained in an even and consistent level which minimizes excessive noise and turbulence within the air funnel 22 and within the blower housing 172 as the flow 48 of process air 32 transitions from the air funnel 22 to the housing for the blower 38.

According to the various aspects of the device, the air funnel 22 for the heat pump system 10 operates to maintain the flow 48 of process air 32 at a consistent and even air pressure 52 and air velocity 60 as the flow 48 of process air 32 moves through the heat exchanger 30. Through this configuration, operation of the heat exchanger 30 has an increased efficiency due to the substantial elimination of pressure drop within a heat exchanger 30. This pressure drop, if not mitigated, can result in areas of a heat exchanger 30 receiving only limited amounts of process air 32, or no process air 32, thereby transferring little to no heat 16 between the process air 32 and the heat exchange media 14. By maintaining the flow 48 of process air 32 through the heat exchanger 30 to be even and consistent, each section of the heat exchanger 30 operates contemporaneously to transfer heat 16 from the process air 32 to the heat exchange media 14. This maintenance of the flow 48 of process air 32 to be consistent within the heat exchanger 30 is achieved through those portions of the air funnel 22 that are downstream of this maintenance portion of the air funnel 22. The entire inner surface 50 of the air funnel 22 operates in cooperation to act upon the flow 48 of process air 32 to manage the venturi effect of the process air 32 as it moves between the downstream surface 62 of the heat exchanger 30 and the port 40 into the blower housing 172.

As exemplified in FIGS. 9-17, the air funnel 22 can include a configuration having a minimal convergence section 120. Such an aspect of the device can be used where the heat exchanger 30 is in closer proximity to the blower 38 or the blower housing 172. In such an aspect of the device, the transition section 110 of the air funnel 22 includes the pressure maintenance portion 112 which surrounds the outer edge 134 of the heat exchanger 30, as well as the pressure regulation portion 114 that extends between the downstream surface 62 of the heat exchanger 30 and the convergence section 120 of the air funnel 22. The convergence section 120 of the air funnel 22 directs the process air 32 through the port 40 which is also defined by the convergence section 120 of the air funnel 22. Additionally, the pressure regulation portion 114 of the air funnel 22 includes the concave portion 140 of the air funnel 22 which directs the process air 32 from the rectangular configuration of the heat exchanger 30 to the circular configuration of the port 40. As described herein, this pressure regulation portion 114 operates to increase the air velocity 60 of the process air 32 and, contemporaneously, decrease the air pressure 52 of the process air 32.

Referring again to FIGS. 9-12, the plate 170 of the air funnel 22 engages the blower housing 172 of the blower 38. Additionally, the plate 170 can be configured to extend across the entirety of the upper housing 82. Through this configuration, the plate 170 separates the volume of the upper housing 82 between a heat exchange section 200 and a blower section 202. Within the heat exchange section 200 of the upper housing 82, various portions of the heat pump system 10 can be located, including the heat exchanger 30, the compressor 92, and other components of the heat pump system 10. The blower section 202 of the upper housing 82 includes the blower 38, including the fan 58 of the blower 38, the motor 56, and the blower housing 172. By dividing the upper housing 82 into the heat exchange section 200 and the blower section 202, operation of the blower 38 serves to efficiently direct process air 32 from the air inlet 70, into the heat exchange section 200, and through the heat exchanger 30. Because the plate 170 divides the upper housing 82 between the heat exchange section 200 and the blower section 202, all of the ambient air 180 that is drawn through the air inlet 70 is moved through the heat exchanger 30 as process air 32.

As described herein, the process air 32 moving through the heat exchanger 30 is manipulated through operation of the air funnel 22 to maintain a consistent air velocity 60 and air pressure 52. This consistent air velocity 60 and air pressure 52 causes the process air 32 to move evenly through the entirety of the heat exchanger 30. In turn, this maximizes the exchange of heat 16 from the process air 32 and into the heat exchange media 14 for heating water 20 within the reservoir of the water heater 12. Use of the plate 170 extending across the entirety of the upper housing 82 also serves to eliminate the unwanted movement of process air 32 around the heat exchanger 30. Preventing this bypass of process air 32 increases the efficiency of the heat pump system 10 for the water heater 12.

As described herein, the port 40 for the air funnel 22 can be positioned in an eccentric location within the pressure regulation portion 114 of the air funnel 22. Accordingly, the shape of the pressure regulation portion 114 of the air funnel 22 is configured to manipulate the process air 32 to maintain the consistent increase of air velocity 60 and the consistent decrease of air pressure 52 as the process air 32 moves through the air funnel 22, as exemplified in FIG. 8 with respect to the various benchmarks annotated therein.

According to various aspects of the device, the plate 170 of the air funnel 22 can be integral with the convergence section 120 and the pressure regulation portion 114 of the air funnel 22. In certain aspects of the device, the plate 170 can be attached to at least one of the pressure regulation portion 114 and the convergence section 120 of the air funnel 22.

According to the various aspects of the device, as exemplified in FIGS. 4-17, the pressure regulation portion 114 of the air funnel 22 can include tapered fillets 210 that assist in converting the rectangular outer perimeter 34 of the pressure maintenance portion 112 of the air funnel 22 into the circular profile of the convergence section 120 of the air funnel 22. The tapered fillets 210 extend between parabolic panels 212 that form the remainder of the pressure regulation portion 114. Together, the tapered fillets 210 and the parabolic panels 212 cooperate to regulate the manipulation of process air 32 as it moves between the heat exchanger 30 and the convergence section 120 of the air funnel 22. The tapered fillets 210 and parabolic panels 212 cooperate to consistently regulate the increase in air velocity 60 of the process air 32 as well as the consistent decrease in air pressure 52 of the process air 32.

According to a first aspect of the disclosure, a water heater includes a heat pump system having a heat exchanger that absorbs heat from process air for delivery into a heat exchange media. The heat exchanger has an outer perimeter that defines a first dimension. The water heater also includes a blower that selectively draws the process air through the heat exchanger. The water heater further includes a funnel that extends between the outer perimeter of the heat exchanger and the blower. The funnel includes a rounded port having an inner perimeter that defines a second dimension that is smaller than the first dimension. The funnel has an inner surface that maintains an air pressure of the process air to be generally consistent within the heat exchanger.

According to another aspect of the disclosure, the heat exchanger includes a rectilinear shape.

According to another aspect of the disclosure, the rounded port is circular.

According to another aspect of the disclosure, the funnel includes a transition section that engages the heat exchanger, and the transition section has a pressure maintenance portion and a pressure regulation portion.

According to another aspect of the disclosure, the funnel includes a convergence section that defines the rounded port and directs the process air from the transition section to the inner perimeter of the rounded port.

According to another aspect of the disclosure, the pressure maintenance portion maintains the air pressure of the process air within the heat exchanger and within a portion of a space within the funnel that is immediately adjacent to the heat exchanger.

According to another aspect of the disclosure, the pressure regulation portion operates to gradually and evenly decrease the air pressure of the process air between the pressure maintenance portion and the convergence section.

According to another aspect of the disclosure, the transition section and the convergence section operate to evenly increase an air velocity of the process air as it moves between the heat exchanger and the blower.

According to another aspect of the disclosure, an airflow system for a water heater includes a heat exchanger that draws heat from process air and delivers the heat to a heat exchange media. The heat exchanger has a rectilinear cross-section defining a first area. The airflow system also includes a blower that delivers the process air through the heat exchanger. The airflow system further includes a funnel that directs the process air from the heat exchanger to the blower. The funnel manages an air pressure of the process air to be consistent within the heat exchanger, and the funnel regulates the air pressure of the process air to decrease evenly and consistently between a downstream surface of the heat exchanger and a rounded port that directs the process air into the blower.

According to another aspect of the disclosure, the funnel includes a transition section that engages the heat exchanger, and the transition section has a pressure maintenance portion and a pressure regulation portion.

According to another aspect of the disclosure, the funnel includes a convergence section that defines the rounded port, and the convergence section directs the process air from the transition section to the rounded port which includes an inner perimeter that defines a second area that is smaller than the first area.

According to another aspect of the disclosure, the pressure maintenance portion maintains the air pressure of the process air to be consistent within the heat exchanger and within a portion of a space within the funnel that is immediately adjacent to the heat exchanger.

According to another aspect of the disclosure, the pressure regulation portion manipulates the process air to gradually and evenly decrease the air pressure of the process air between the pressure maintenance portion and the convergence section.

According to another aspect of the disclosure, the rounded port is circular.

According to another aspect of the disclosure, the transition section of the funnel at least partially surrounds an outer edge of the heat exchanger.

According to another aspect of the disclosure, a heat exchange system for a water heater includes an evaporator that draws heat from process air. A heat exchanger delivers the heat to a heat exchange media, and the heat exchanger has a generally rectilinear cross-section that defines a first area. The heat exchange system also has a blower that delivers the process air through the evaporator. The heat exchange system further has a funnel that at least partially surrounds an outer edge of the evaporator and includes a circular port that directs the process air from the evaporator to the blower. The circular port defines an inner perimeter that defines a second area that is smaller than the first area. Further, the funnel manages an air velocity of the process air to be even and consistent within the heat exchanger, and the funnel regulates the air velocity of the process air to define a consistent increase as the process air moves between a downstream surface of the evaporator and the circular port.

According to another aspect of the disclosure, the funnel includes a transition section that engages the evaporator, and the transition section has a pressure maintenance portion and a pressure regulation portion.

According to another aspect of the disclosure, the funnel includes a convergence section that defines the circular port and directs the process air from the transition section to the inner perimeter of the circular port.

According to another aspect of the disclosure, the pressure maintenance portion maintains the air velocity of the process air to be consistent within the heat exchanger.

According to another aspect of the disclosure, the pressure regulation portion operates to gradually and evenly increase the air velocity of the process air between the pressure maintenance portion and the convergence section.

According to another aspect of the disclosure, a water heating appliance includes a heat exchanger that draws heat from process air. The heat exchanger delivers the heat to a heat exchange media and has a polygonal cross-section defining a first area. The water heating appliance also includes a blower that delivers the process air through the heat exchanger. The water heating appliance further includes a funnel that directs the process air from the heat exchanger to the blower. The funnel manages an air pressure of the process air to be consistent within the heat exchanger, and the funnel regulates the air pressure of the process air to decrease evenly and consistently between a downstream surface of the heat exchanger and a rounded port that directs the process air into the blower.

According to another aspect of the disclosure, the funnel includes a transition section that engages the heat exchanger, and the transition section has a pressure maintenance portion and a pressure regulation portion.

According to another aspect of the disclosure, the funnel includes a convergence section that defines the rounded port and directs the process air from the transition section to the rounded port which includes an inner perimeter that defines a second area that is smaller than the first area.

According to another aspect of the disclosure, the pressure maintenance portion maintains the air pressure of the process air to be consistent within the heat exchanger and within a portion of a space within the funnel that is immediately adjacent to the heat exchanger.

According to another aspect of the disclosure, pressure regulation portion manipulates the process air to gradually and evenly decrease the air pressure of the process air between the pressure maintenance portion and the convergence section.

According to another aspect of the disclosure, the transition section and the convergence section operate to evenly increase an air velocity of the process air as it moves between the downstream surface of the heat exchanger and the rounded port.

According to another aspect of the disclosure, the rounded port is circular.

According to another aspect of the disclosure, the transition section of the funnel at least partially surrounds an outer edge of the heat exchanger.

According to another aspect of the disclosure, the pressure regulation portion of the funnel includes a plurality of parabolic panels that extend from the heat exchanger to the rounded port.

According to another aspect of the disclosure, the pressure regulation portion includes a plurality of tapered fillets that are respectively positioned between adjacent parabolic panels of the plurality of parabolic panels.

According to another aspect of the disclosure, the polygonal cross-section of the heat exchanger that defines the first area is a rectilinear cross-section.

According to another aspect of the disclosure, the air funnel operates to minimize uneven air pressure areas within the heat exchanger.

According to another aspect of the disclosure, the rounded port is in an off-center position within the air funnel with respect to the heat exchanger.

According to another aspect of the disclosure, the air funnel includes a plate that engages a blower housing of the blower.

According to another aspect of the disclosure, the heat exchanger, the blower and the air funnel are positioned within an interior outer housing, and the plate extends outward from the rounded port and engages walls of the outer housing.

According to another aspect of the disclosure, the plate divides an interior of an upper housing into a heat exchange section and a blower section.

According to another aspect of the disclosure, the blower is positioned within the blower section and the heat exchanger is positioned within the heat exchange section, and the plate prevents the process air from traveling from the heat exchange section to the blower section outside of the rounded port.

According to another aspect of the disclosure, the heat exchanger is an evaporator that is in thermal communication with a condensing portion in thermal communication with a reservoir containing liquid to be heated.

It will be understood by one having ordinary skill in the art that construction of the described disclosure and other components is not limited to any specific material. Other exemplary embodiments of the disclosure disclosed herein may be formed from a wide variety of materials, unless described otherwise herein.

What is claimed is:

1. A water heating appliance comprising:

a heat exchanger that draws heat from process air, wherein the heat exchanger delivers the heat to a heat exchange media, the heat exchanger having a polygonal cross-section defining a first area;

a blower that delivers the process air through the heat exchanger; and a funnel that directs the process air from the heat exchanger to the blower, wherein the funnel manages an air pressure of the process air to be consistent within the heat exchanger, and wherein the funnel regulates the air pressure of the process air to decrease evenly and consistently between a downstream surface of the heat exchanger and a port that directs the process air into the blower, wherein the funnel includes a plate that engages a blower housing of the blower.

2. The water heating appliance of claim 1, wherein the funnel includes a transition section that engages the heat exchanger, the transition section having a pressure maintenance portion and a pressure regulation portion.

3. The water heating appliance of claim 2, wherein the funnel includes a convergence section that defines the port, wherein the convergence section directs the process air from the transition section to the port, wherein the port includes an inner perimeter that defines a second area, the second area being smaller than the first area.

4. The water heating appliance of claim 3, wherein the pressure regulation portion manipulates the process air to gradually and evenly decrease the air pressure of the process air between the pressure maintenance portion and the convergence section.

5. The water heating appliance of claim 3, wherein the transition section and the convergence section operate to evenly increase an air velocity of the process air as it moves between the downstream surface of the heat exchanger and the port.

6. The water heating appliance of claim 2, wherein the pressure maintenance portion maintains the air pressure of the process air to be consistent within the heat exchanger and within a portion of a space within the funnel that is immediately adjacent to the heat exchanger.

7. The water heating appliance of claim 2, wherein the transition section of the funnel at least partially surrounds an outer edge of the heat exchanger.

8. The water heating appliance of claim 2, wherein the pressure regulation portion of the funnel includes a plurality of parabolic panels that extend from the heat exchanger to the port.

9. The water heating appliance of claim 8, wherein the pressure regulation portion includes a plurality of tapered fillets that are respectively positioned between adjacent parabolic panels of the plurality of parabolic panels.

10. The water heating appliance of claim 1, wherein the port is a rounded port.

11. The water heating appliance of claim 1, wherein the polygonal cross-section of the heat exchanger that defines the first area is a rectilinear cross-section.

12. The water heating appliance of claim 1, wherein the air funnel operates to minimize uneven air pressure areas within the heat exchanger.

13. The water heating appliance of claim 1, wherein the port is in an off-center position within the air funnel with respect to the heat exchanger.

14. The water heating appliance of claim 1, wherein the heat exchanger, the blower and the air funnel are positioned within an interior outer housing, and wherein the plate extends outward from the port and engages walls of the outer housing.

15. The water heating appliance of claim 14, wherein the plate divides an interior of an upper housing into a heat exchange section and a blower section.

16. The water heating appliance of claim 15, wherein the blower is positioned within the blower section and the heat exchanger is positioned within the heat exchange section, wherein the plate prevents the process air from traveling from the heat exchange section to the blower section outside of the port.

17. The water heating appliance of claim 1, wherein the heat exchanger is an evaporator that is in thermal communication with a condensing portion in thermal communication with a reservoir containing liquid to be heated.

18. A water heating appliance comprising:

a heat exchanger that draws heat from process air, wherein the heat exchanger delivers the heat to a heat exchange media, the heat exchanger having a polygonal cross-section defining a first area;

a blower that delivers the process air through the heat exchanger; and a funnel that directs the process air from the heat exchanger to the blower, wherein the funnel manages an air pressure of the process air to be consistent within the heat exchanger;

the funnel regulates the air pressure of the process air to decrease evenly and consistently between a downstream surface of the heat exchanger and a port that directs the process air into the blower;

the funnel includes a transition section that engages the heat exchanger, the transition section having a pressure maintenance portion and a pressure regulation portion; and the pressure regulation portion of the funnel includes a plurality of parabolic panels that extend from the heat exchanger to the port.

19. The water heating appliance of claim 18, wherein the funnel includes a convergence section that defines the port, wherein the convergence section directs the process air from the transition section to the port.

20. The water heating appliance of claim 18, wherein the port includes an inner perimeter that defines a second area, the second area being smaller than the first area.

* * * * *